US007137884B2

(12) United States Patent
Gilmore

(10) Patent No.: US 7,137,884 B2
(45) Date of Patent: Nov. 21, 2006

(54) GAMING MACHINE FOR AWARDING A BONUS IN ACCORDANCE WITH A SYMBOL ASSOCIATION BEING DISPLAYED ON A FIRST DISPLAY AND ON A SECOND DISPLAY

(75) Inventor: Jason C. Gilmore, Bartlett, IL (US)

(73) Assignee: WMS Gaming Inc., Waukegan, IL (US)

( * ) Notice: Subject to any disclaimer, the term of this patent is extended or adjusted under 35 U.S.C. 154(b) by 308 days.

(21) Appl. No.: 10/162,505

(22) Filed: Jun. 4, 2002

(65) Prior Publication Data

US 2003/0224851 A1 Dec. 4, 2003

(51) Int. Cl.
*A63F 9/24* (2006.01)

(52) U.S. Cl. ..... 463/16; 463/20

(58) Field of Classification Search ..... 463/20, 463/16

See application file for complete search history.

(56) References Cited

U.S. PATENT DOCUMENTS 4,648,600 A * 3/1987 Olliges ..... 463/20
4,695,053 A * 9/1987 Vazquez et al. ..... 463/18
5,823,874 A 10/1998 Adams ..... 463/17
5,848,932 A 12/1998 Adams ..... 463/20
6,135,884 A * 10/2000 Hedrick et al. ..... 463/20
6,336,863 B1 1/2002 Baerlocher et al. ..... 463/27

FOREIGN PATENT DOCUMENTS

WO WO 01/19476 A1 3/2001
WO WO 01/93966 A1 12/2001
WO WO 02/04080 A1 1/2002

OTHER PUBLICATIONS

Christensen, Slot Machines, A Pictorial Review, Vestal Press, 1972, pp. 98-99.*

* cited by examiner

*Primary Examiner*—Corbett B. Coburn
(74) *Attorney, Agent, or Firm*—Jenkens & Gilchrist

(57) ABSTRACT

A gaming machine conducts a wagering game. The machine includes a first display of a first type for displaying a primary game outcome, and a second display of a second type for displaying a secondary game outcome. The second type is different from the first type. A control system awards a first award if the primary outcome is a winning outcome, and awards a second award if the secondary outcome has a predetermined association with the winning outcome.

29 Claims, 12 Drawing Sheets

GAMING MACHINE FOR AWARDING A BONUS IN ACCORDANCE WITH A SYMBOL ASSOCIATION BEING DISPLAYED ON A FIRST DISPLAY AND ON A SECOND DISPLAY

FIELD OF THE INVENTION

The present invention relates generally to gaming machines and, more particularly, to a gaming machine including two different types of game displays for displaying selected outcomes and yielding a bonus when the selected outcomes have a predetermined relationship.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning each machine is roughly the same (or believed to be the same), players are most likely to be attracted to the most entertaining and exciting of the machines. Shrewd operators consequently strive to employ the most entertaining and exciting machines available because such machines attract frequent play and hence increase profitability to the operator. Accordingly, in the competitive gaming machine industry, there is a continuing need for gaming machine manufacturers to produce new types of games, or enhancements to existing games, which will attract frequent play by enhancing the entertainment value and excitement associated with the game.

SUMMARY OF THE INVENTION

A gaming machine conducts a wagering game. The machine includes a first display of a first type for displaying a primary game outcome, and a second display of a second type for displaying a secondary game outcome. The second type is different from the first type. A control system awards a first award if the primary outcome is a winning outcome, and awards a second award if the secondary outcome has a predetermined association with the winning outcome.

BRIEF DESCRIPTION OF THE DRAWINGS

The foregoing and other advantages of the invention will become apparent upon reading the following detailed description and upon reference to the drawings.

Figure 1:
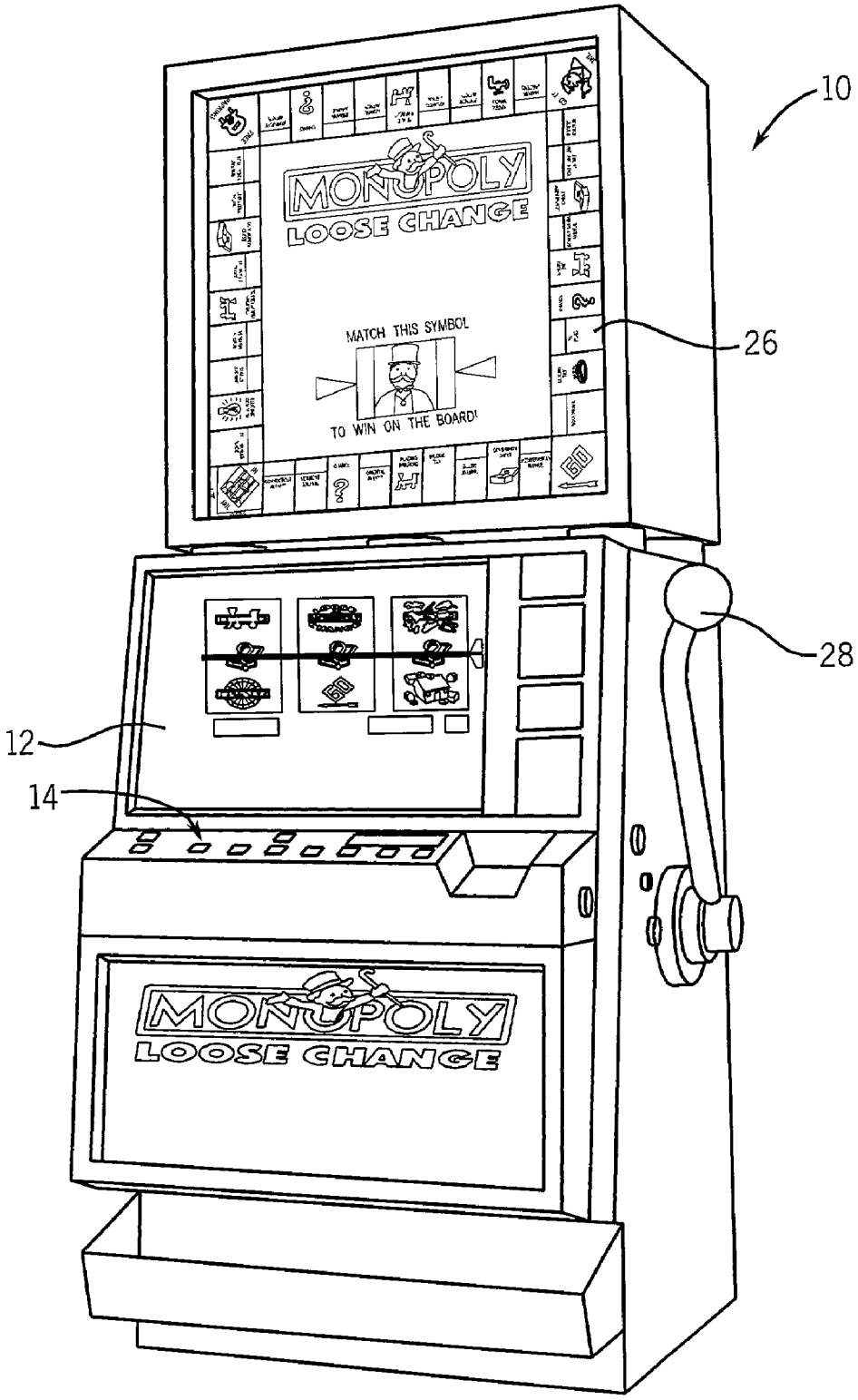
FIG. 1 is an isometric view of a gaming machine for conducting a wagering game in accordance with the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

Turning now to the drawings, FIG. 1 depicts a gaming machine 10 operable to conduct a wagering game such as slots, poker, keno, bingo, or blackjack. In operation, the gaming machine receives a wager from a player to purchase a "play" of the game. In a "play" of the game, the gaming machine generates at least one random event using a random number generator (RNG) and provides an award to the player for a winning outcome of the random event. The random event(s) varies with the type of wagering game conducted on the gaming machine.

The gaming machine 10 includes a first display 12 of a first type and a second display 26 of a second type. The second type is different from the first type. In one embodiment the display 12 includes a mechanical or video spinning reel display, while the display 26 includes at least one of a wheel and a game board containing a plurality of selectable visible regions. The game board may, for example, be implemented on a video display or back-lit printed glass and be based on an attractive theme like Monopoly™ as illustrated. Any video display may be implemented with a CRT, LCD, plasma, or other type of video display known in the art. The display 12, especially if implemented in video, may be overlaid with a touch screen to facilitate interaction with the player. In the illustrated embodiment, the gaming machine 10 is an "upright" version in which the display 12 is oriented vertically relative to the player. Alternatively, the gaming machine may be a "slant-top" version in which the display 12 is slanted at about a thirty-degree angle toward the player of the gaming machine 10.

Figure 2:
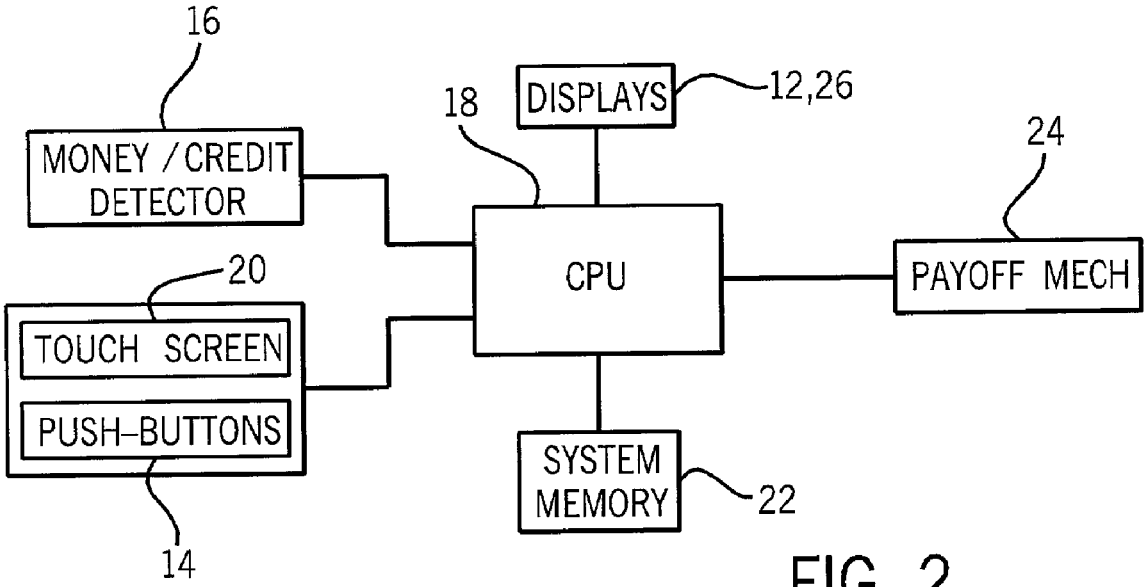
FIG. 2 is a block diagram of a control system suitable for operating the gaming machine.

FIG. 2 is a block diagram of a control system suitable for operating the gaming machine. Money/credit detector 16 signals a central processing unit (CPU) 18 when a player has inserted money or played a number of credits. The money may be provided by coins, bills, tickets, coupons, cards, etc. Using a button panel 14 (see FIG. 1) or a touch screen 20, the player may select any variables associated with the wagering game and place his/her wager to purchase a play of the game. In a play of the game, the CPU 18 generates at least one random event using a random number generator (RNG) and provides an award to the player for a winning outcome of the random event. The CPU 18 operates the displays 12 and 26 to represent the random events and outcomes in a visual form that can be understood by the player. In addition to the CPU 18, the control system may include one or more additional slave control units for operating one or more of the displays 12 and 26.

A system memory 22 stores control software, operational instructions and data associated with the gaming machine. In one embodiment, the system memory 22 comprises a separate read-only memory (ROM) and battery-backed random-access memory (RAM). However, it will be appreciated that the system memory 22 may be implemented on any of several alternative types of memory structures or may be implemented on a single memory structure. A payoff mechanism 24 is operable in response to instructions from the CPU 18 to award a payoff to the player. The payoff may, for example, be in the form of a number of credits. The number of credits are determined by one or more math tables stored in the system memory 22.

In accordance with the present invention, the control system randomly selects a primary game outcome from a plurality of possible primary outcomes and then operates the display 12 to display the primary game outcome. Similarly, the control system randomly selects a secondary game outcome from a plurality of possible secondary outcomes and then operates the display 26 to display the secondary game outcome. The control system awards a first award if the primary outcome is a winning outcome, and awards a second award if the secondary outcome has a predetermined association with the winning outcome.

Figure 3:
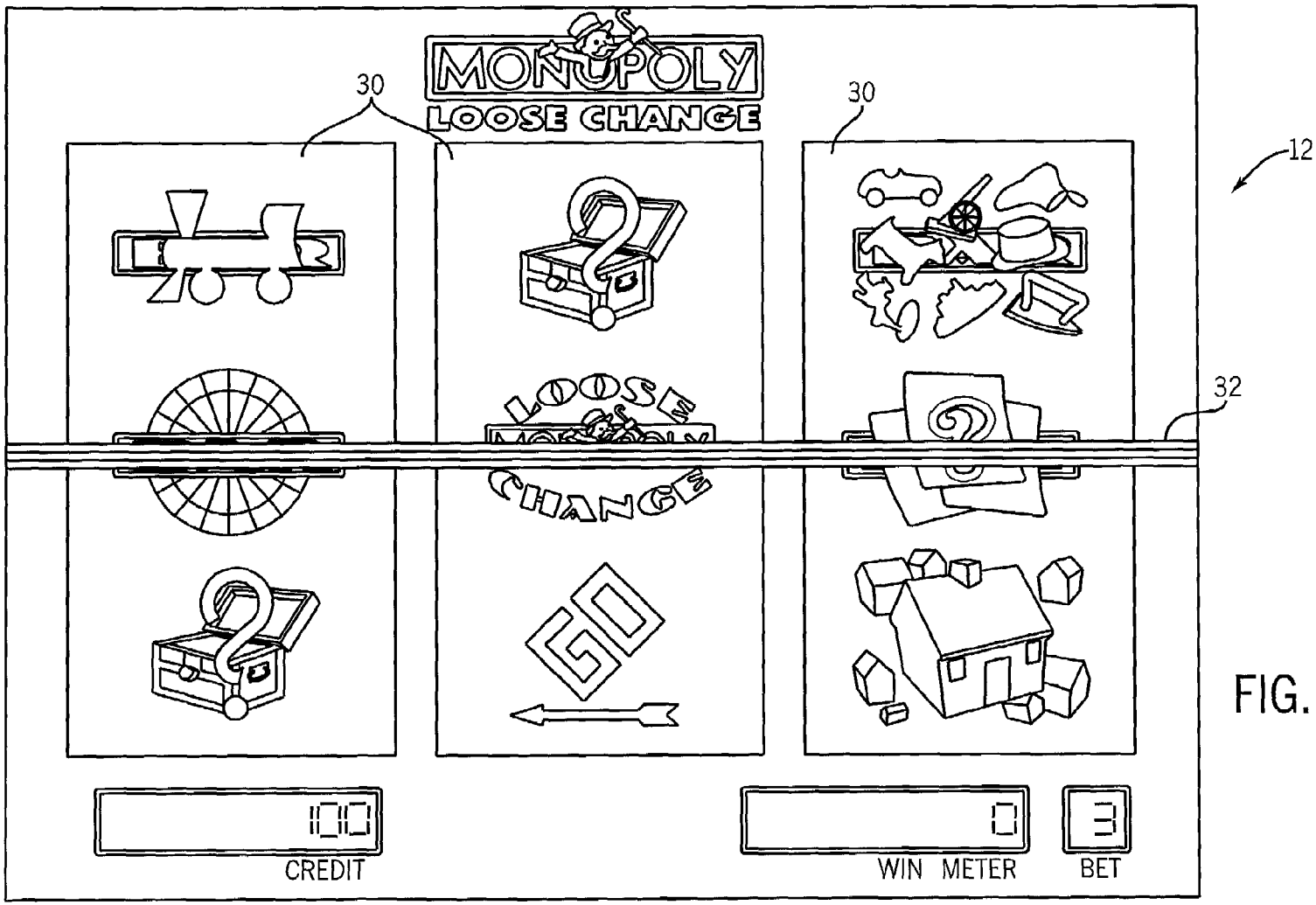
FIG. 3 is an enlarged front view of a spinning reel display of the gaming machine.

Referring to FIG. 3, by way of example the display 12 is a spinning reel display having a plurality of symbol-bearing reels 30 that are rotated and stopped to place symbols on the reels in visual association with at least one pay line 32. The symbols along the pay line 32 represent the primary game outcome. The reels 30 may be simulated with moving graphics on a video display, or may be physical and driven by stepper motors. Additional pay lines may be provided, in which case the player is allowed to wager on more than one pay line. The number of illustrated reels 30 is three but a different number of reels may be provided if desired.

Figure 4:
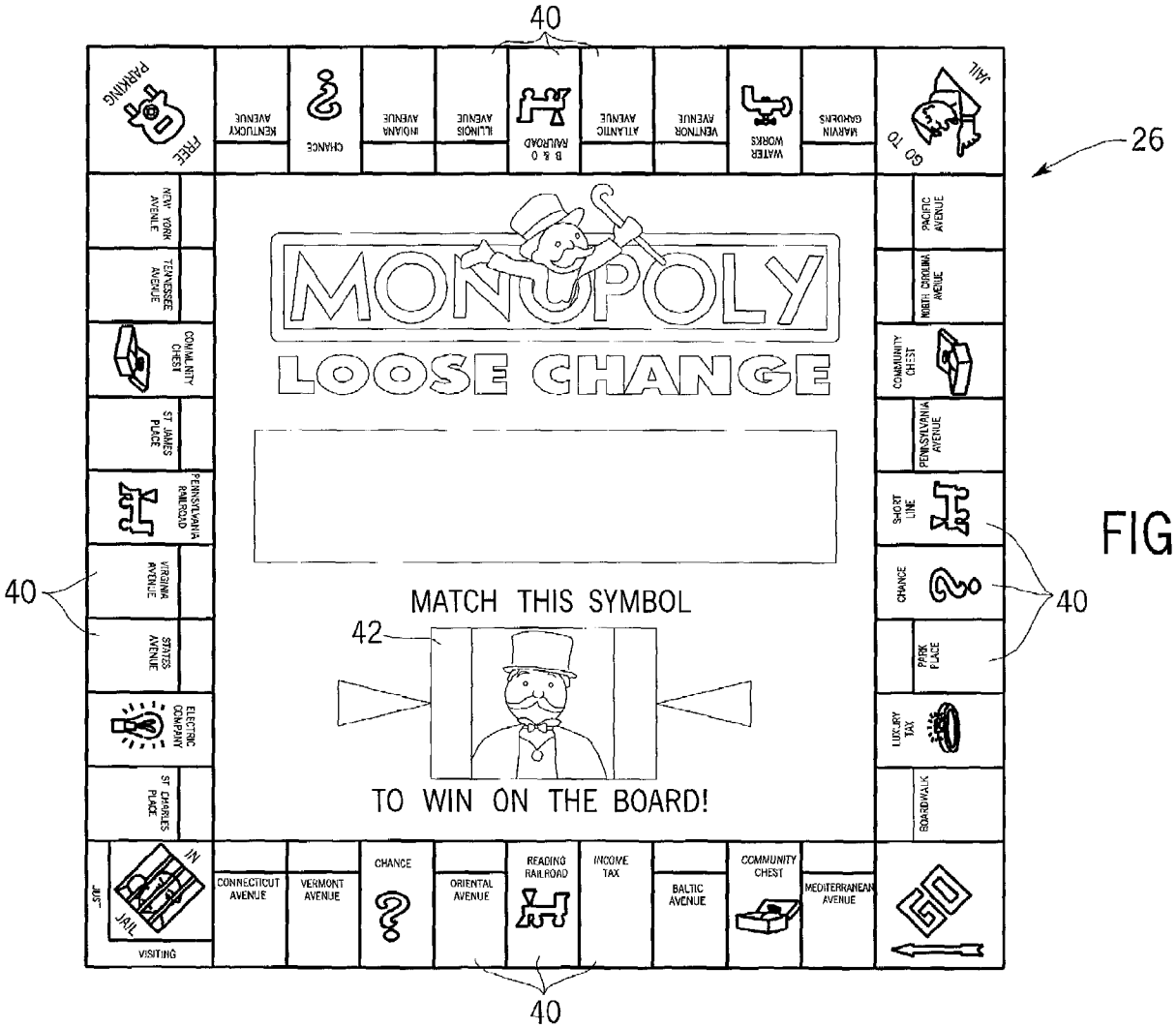
FIG. 4 is an enlarged front view of a game board of the gaming machine.

Referring to FIG. 4, by way of example the display 26 is a game board for displaying an additional symbol representing the secondary game outcome. The game board 26 may, for example, be a Monopoly® board having a plurality of spaces 40 along its periphery. As on a traditional Monopoly board, the plurality of spaces 40 may include street properties, four railroads, two tax spaces (e.g., Income Tax and Luxury Tax), two utilities (e.g., Electric Company and Water Works), four corners (e.g., Go, Jail, Free Parking, and Go To Jail), Community Chest, and Chance. To select a space 40, a space identifier randomly or sequentially moves along the game board 26 until landing on one of the spaces 40. The space identifier may, for example, be a game token or a space highlighter. Prior to moving, the space identifier may start from the "Go" space, from a randomly-selected space, or from a space landed upon in a preceding move. If the space identifier moves sequentially along the game board 26, the number of spaces traversed by the space identifier may be determined by a pair of rolled dice. The space on which the space identifier lands represents the secondary game outcome. The game board 26 optionally includes an interior space display 42 for displaying an enlarged view of the space on which the space identifier lands.

In each play of the wagering game, a player places a wager and then both the spinning reel display 12 in FIG. 3 and the game board 26 in FIG. 4, in turn, display respective outcomes randomly selected by the control system. For the spinning reel display 12, the symbols that land along the pay line 32 represent the primary game outcome. For the game board 26, the space marked by the space identifier represents the secondary game outcome. The control system awards a payout if the primary outcome is a winning outcome (e.g., three matching symbols along the pay line 32). The control system increases that payout if the secondary outcome has a predetermined association with the winning outcome (e.g., the symbol on the space identified by the space identifier matches the three symbols along the pay line 32). The increase in the payout may, for example, be multiplication of the payout by a multiplier revealed by the space marked by the space identifier. Alternatively, the payout may be increased by a random credit amount that is not determined by multiplying the payout by a multiplier.

The remaining figures provide examples of play of the wagering game utilizing the spinning reel display 12 in FIG. 3 and the game board 26 in FIG. 4.

Figure 5:
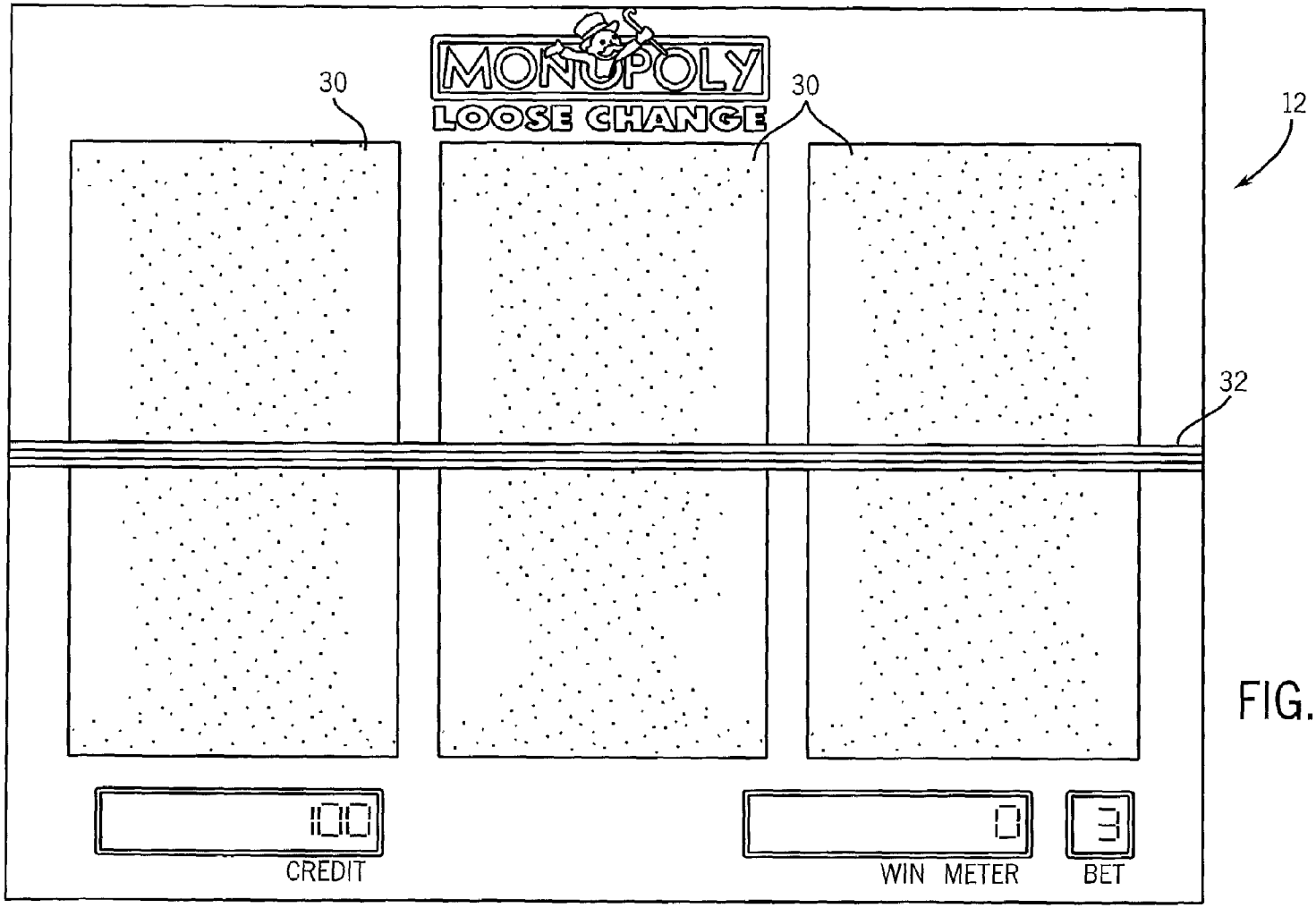
FIGS. 5 and 6 depict the spinning reel display and the game board, respectively, in the process of displaying respective outcomes in a first example of play of the wagering game.
Figure 6:
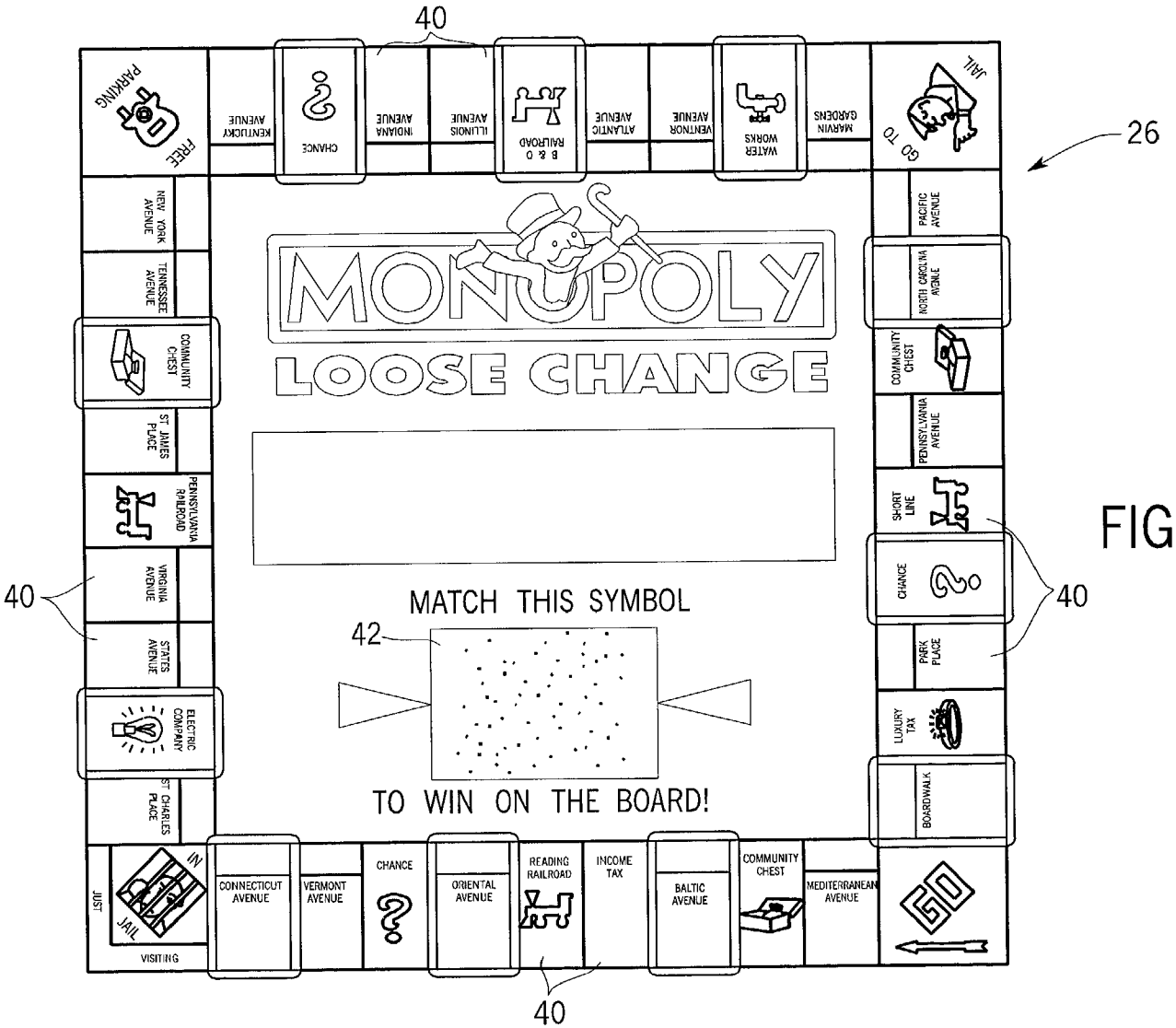

FIGS. 5 and 6 depict the spinning reel display 12 and the game board 26, respectively, in the process of displaying respective outcomes in a first example of play of the wagering game. To begin play, a player places a wager using a "bet one" key or a "max bet" key on the button panel 14 (see FIG. 1). In response to pressing the "max bet" key, or a "spin reels" key for a wager less than the maximum, the control system spins the reels 30 on the spinning reel display 12 and randomly (or sequentially) illuminates the spaces 40 on the game board 26. The interior space display 42 of the game board 26 may show "spinning" spaces while the spaces 40 on the game board 26 are randomly lit. Other mechanisms, such as a handle 28 (see FIG. 1), may be used to set the reels 30 in motion.

Figure 7:
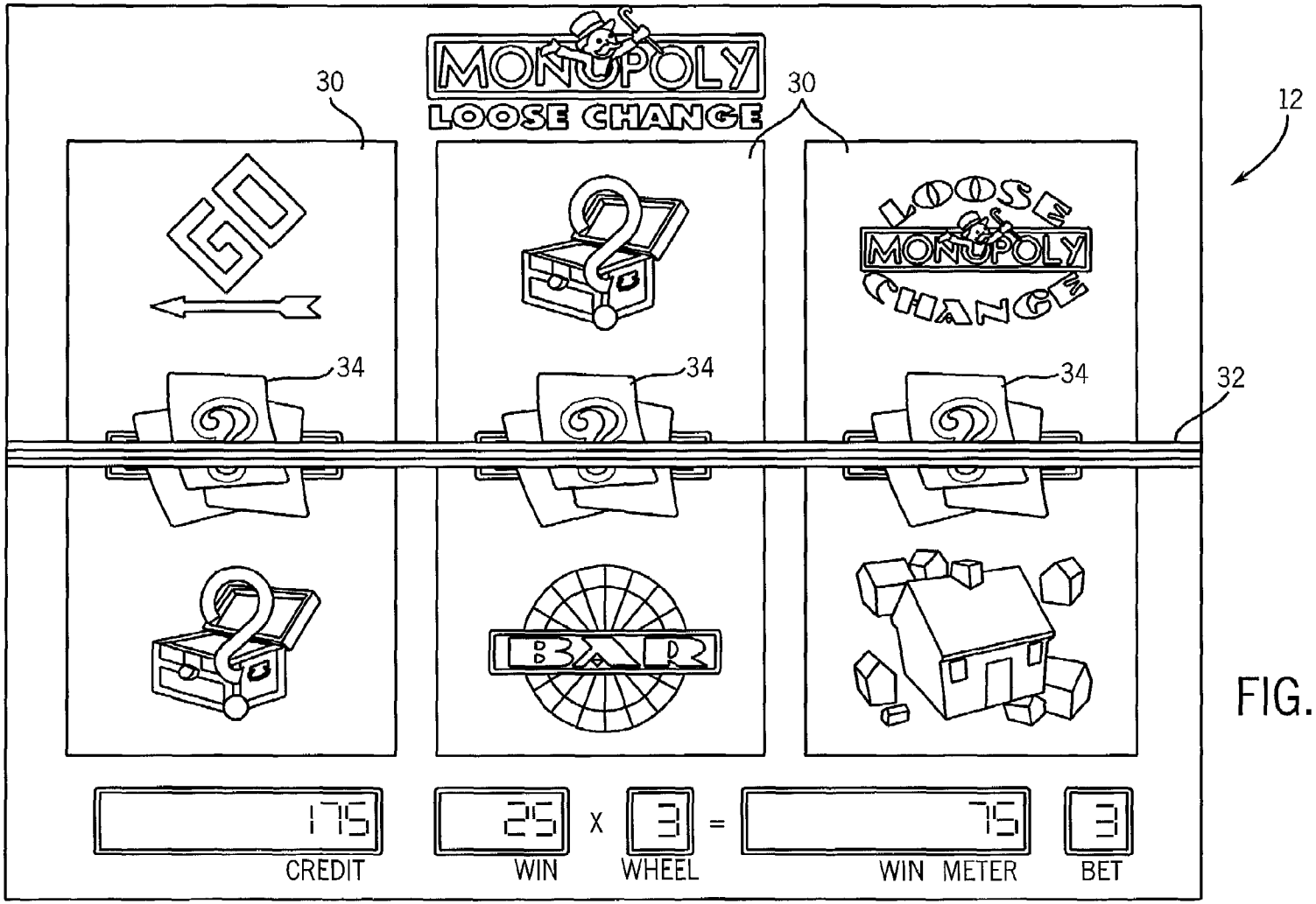
FIGS. 7 and 8 depict the spinning reel display and the game board, respectively, after displaying the respective outcomes in the first example.
Figure 8:
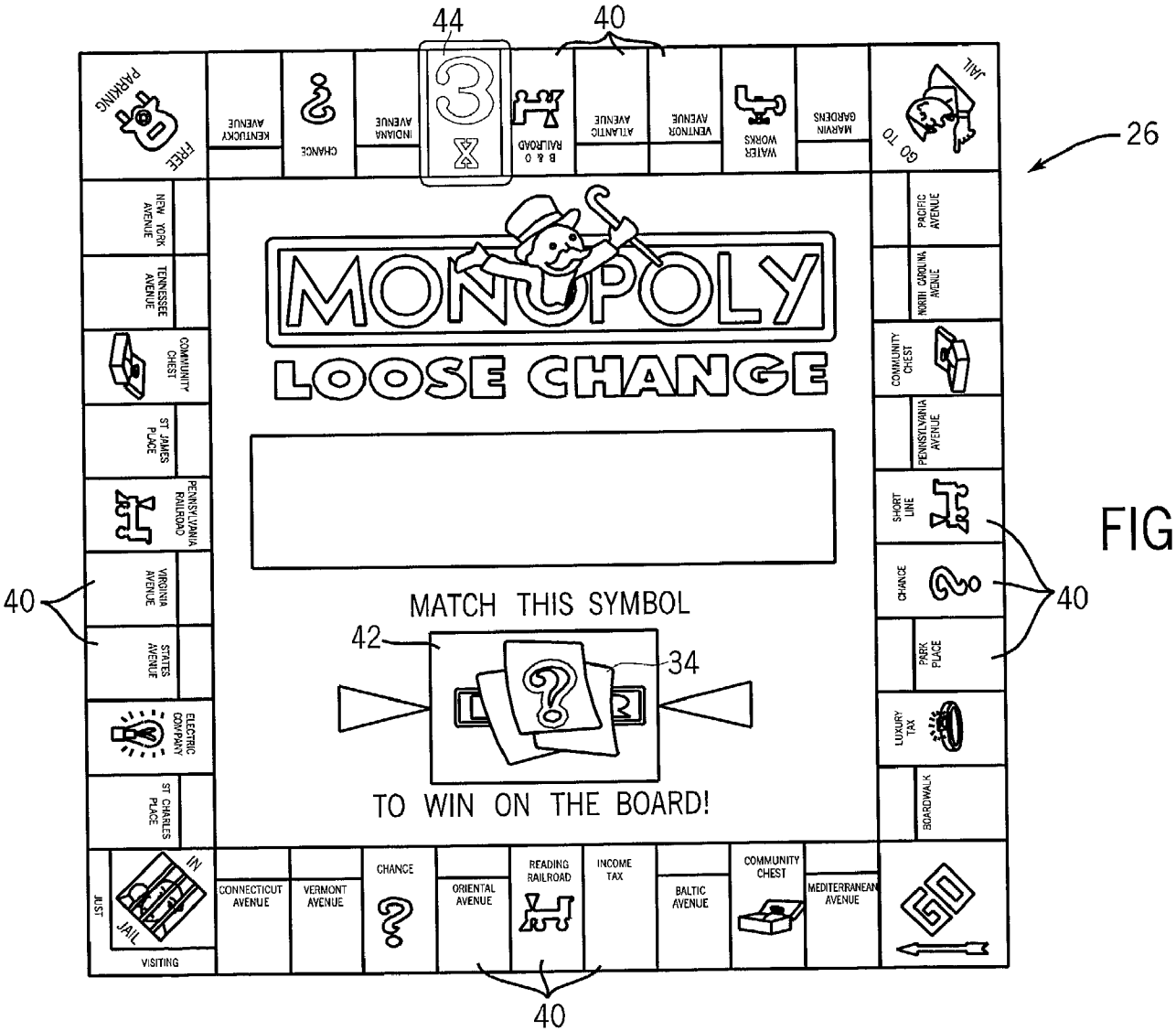

The control system uses a random number generator to randomly select a primary game outcome and a secondary game outcome. Based on the selected primary outcome, the control system operates the spinning reel display 12 to stop the reels 30 with respective symbols along the pay line 32. At approximately the same time, based on the selected secondary outcome, the control system operates the game board 26 to stop the space identifier on one of the spaces 40. The selected space is shown in the space display 42. Referring to FIG. 7, in the illustrated example three PROPERTY symbols 34 land along the pay line 32 to yield a payout of 25 credits. Referring to FIG. 8, in the illustrated example the space identifier stops on a property space 44 as well, as indicated by a PROPERTY symbol 34 in the space display 42. The property space 44 "flips over" to reveal a multiplier of 3×. The payout of 25 credits is multiplied by this multiplier of 3× to yield a total payout of 75 credits (e.g., 3×25=75) for the current play of the wagering game. If the space identifier had not stopped on a property space 44, the payout would have remained at 25 credits and would not have been increased.

Figure 9:
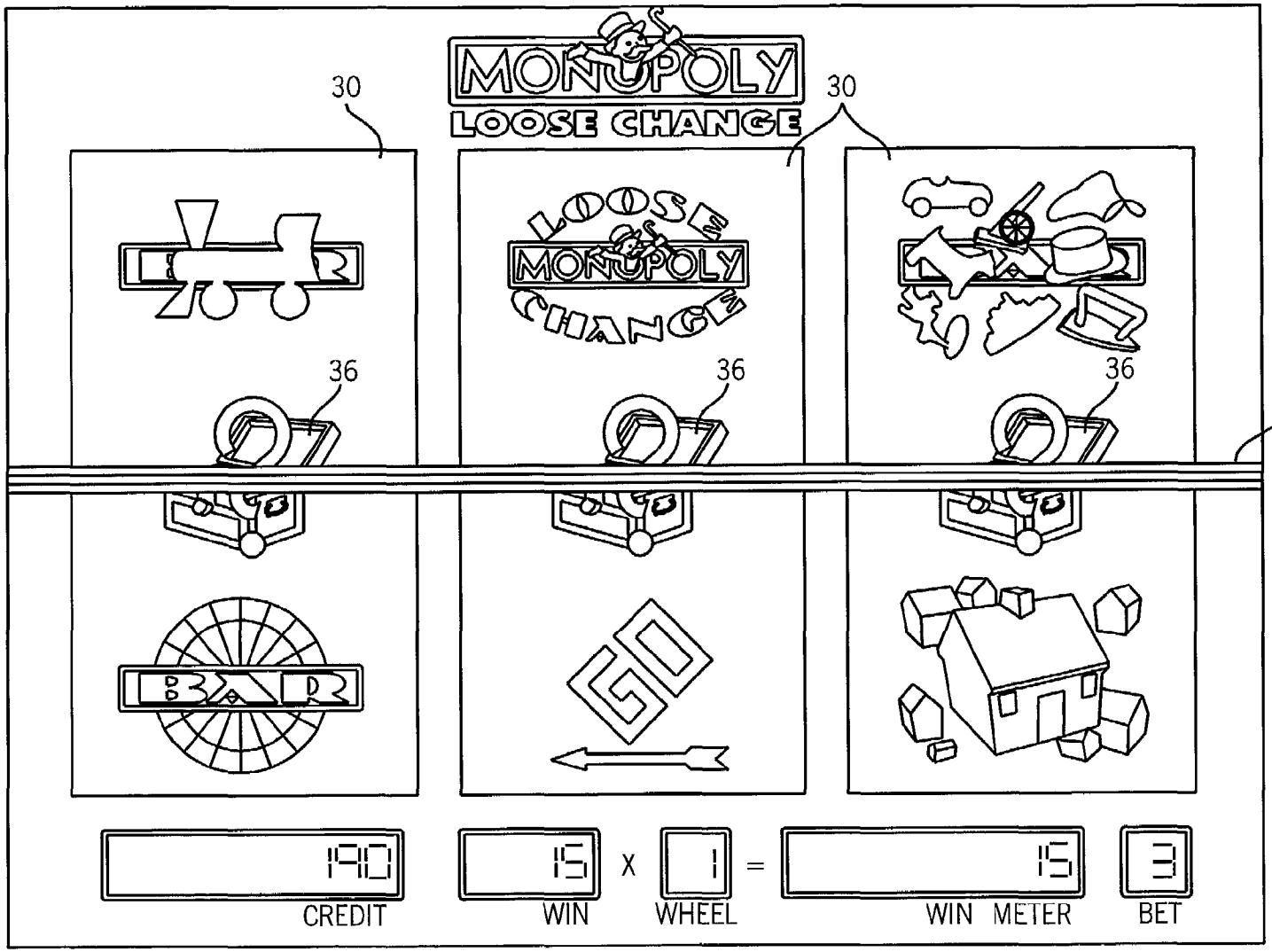
FIGS. 9 and 10 depict the spinning reel display and the game board, respectively, after displaying respective outcomes in a second example of play of the wagering game.
Figure 10:
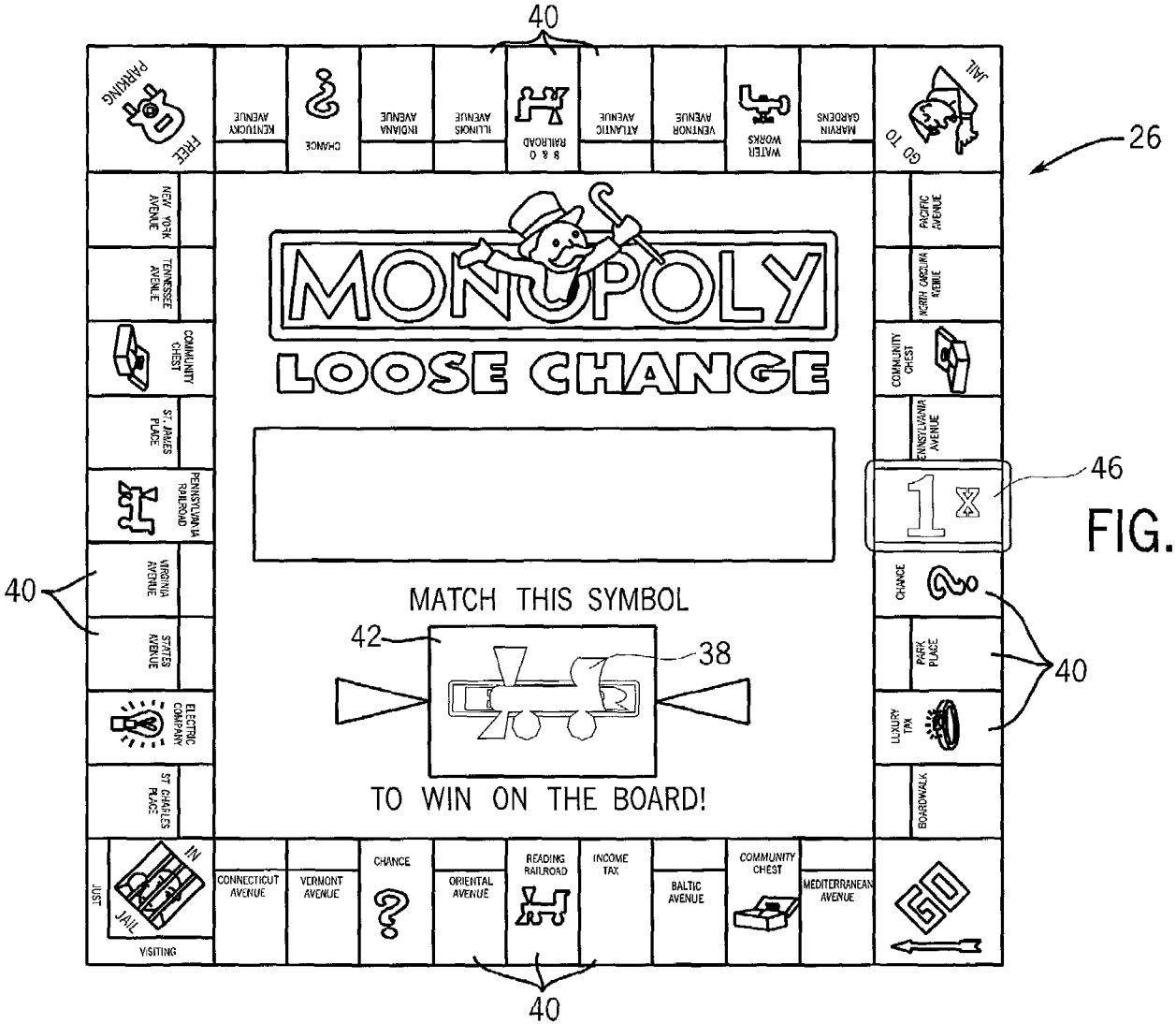

FIGS. 9 and 10 depict the spinning reel display 12 and the game board 26, respectively, after displaying respective outcomes in a second example of play of the wagering game. Referring to FIG. 9, in the illustrated example three CHANCE/COMMUNITY CHEST symbols 36 land along the pay line 32 to yield a payout of 15 credits. The CHANCE/COMMUNITY CHEST symbol 36 matches any space 40 on the game board 26 for the purpose of increasing the payout. Referring to FIG. 10, in the illustrated example the space identifier stops on a railroad 46, as indicated by a RAILROAD symbol 38 in the space display 42. The railroad 46 "flips over" to reveal a multiplier of 1×. The payout of 25 credits is multiplied by this multiplier of 1× to maintain the payout at 15 credits (e.g., 1×15=15).

Figure 11:
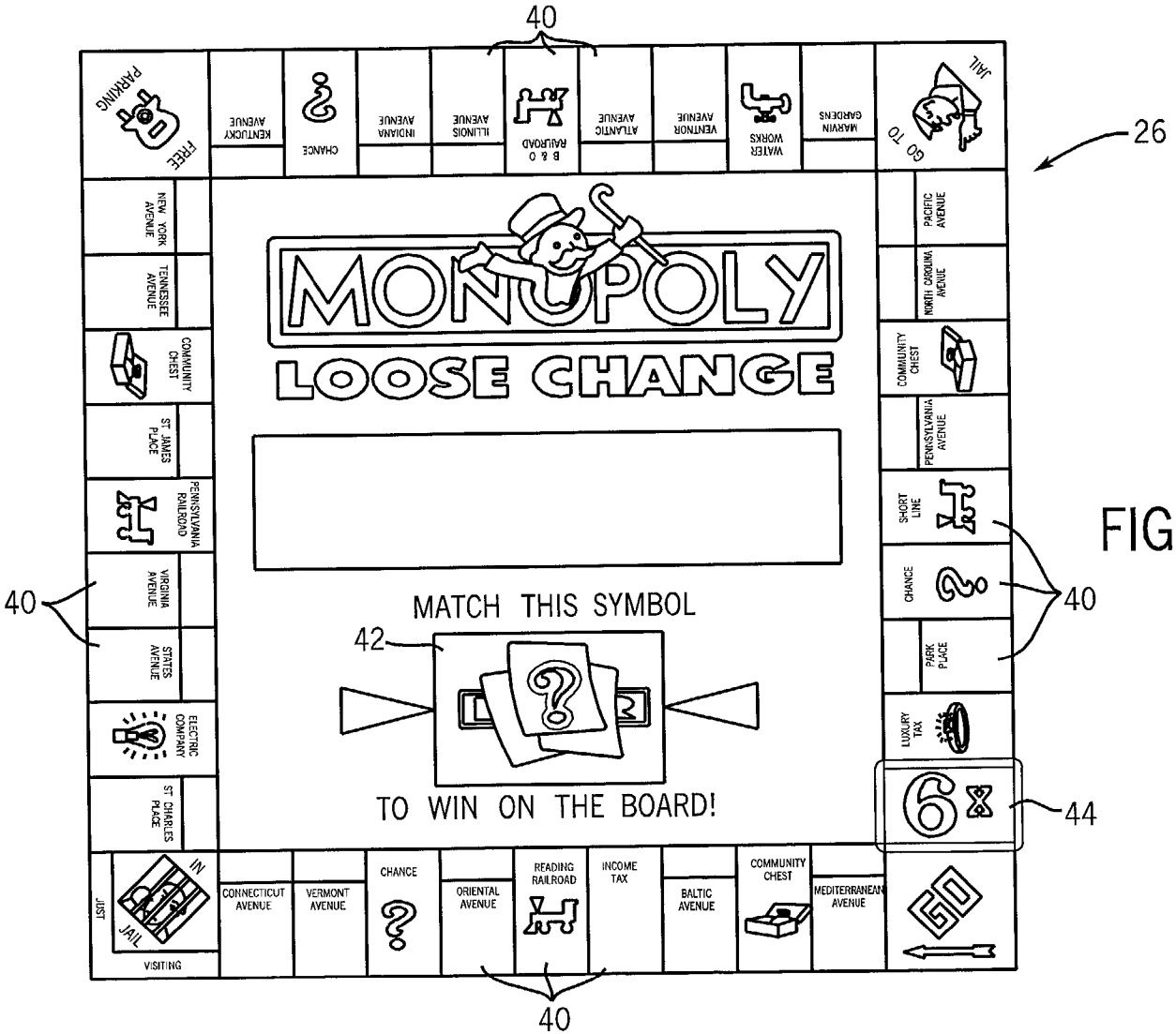
FIGS. 11 and 12 depict the game board displaying free bonuses in the second example.
Figure 12:
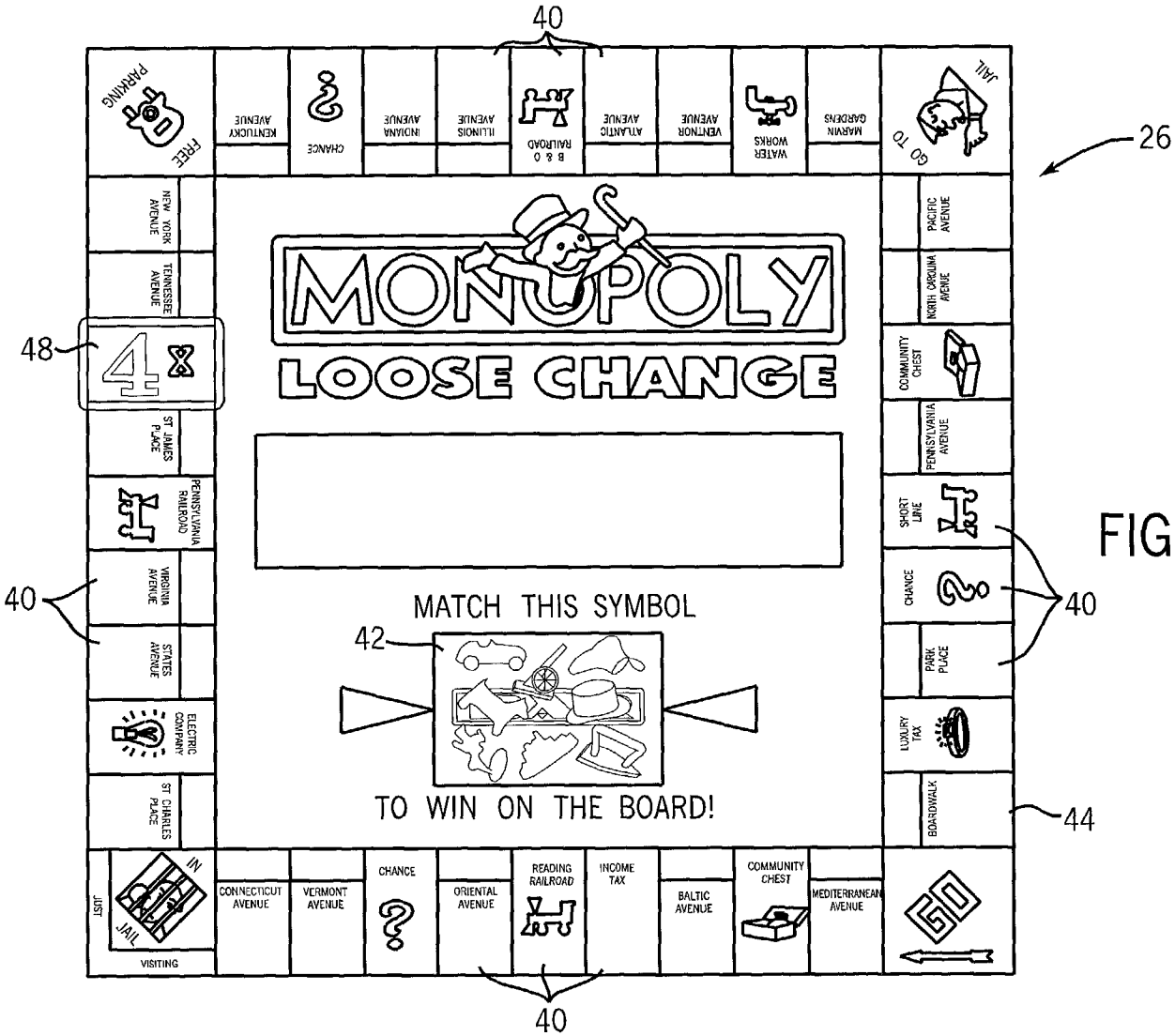

In accordance with a preferred embodiment, however, when three CHANCE/COMMUNITY CHEST symbols 36 land along the pay line 32, the control system awards the player with two free moves on the game board 26. Each of the free moves on the game board 26 yields a free multiplier for multiplying the initial payout of 15 credits. Referring to FIG. 11, in a first free move in the illustrated example, the space identifier stops on a property space 44. The property space 44 "flips over" to reveal a multiplier of 6×. The payout of 15 credits is multiplied by this multiplier of 6× to yield a bonus of 90 credits (e.g., 6×15=90) for the first free move. Referring to FIG. 12, in a second free move in the illustrated example, the space identifier stops on Community Chest 48. Community Chest 48 "flips over" to reveal a multiplier of 4×. The payout of 15 credits is multiplied by this multiplier of 4× to yield a bonus of 60 credits (e.g., 4×15=60) for the second free move. The above bonuses of 90 credits for the first free move and 60 credits for the second free move are added to the payout of 15 credits that existed prior to the two free moves, thereby yielding a total payout of 165 credits for the current play of the wagering game.

While the present invention has been described with reference to one or more particular embodiments, those skilled in the art will recognize that many changes may be made thereto without departing from the spirit and scope of the present invention. For example, the gaming machine 10 may be implemented with themes based on something other than the popular board game MONOPOLY®. In addition, the control system may operate the game board 26 after operating the spinning reel display 12, instead of at the same time as the spinning reel display 12. Because the outcome of the game board 26 is only relevant if the spinning reel display 12 shows a winning outcome, the game board 26 may remain dormant until a winning outcome occurs on the spinning reel display 12. The winning outcome then triggers operation of the game board 26. Each of these embodiments and obvious variations thereof is contemplated as falling within the spirit and scope of the claimed invention, which is set forth in the following claims:

What is claimed is:

1. A gaming machine for conducting a wagering game, comprising:

a first display for displaying a primary game outcome of a primary game;

a second display for displaying a secondary game outcome of a secondary game, the second display being a video display, the secondary game outcome being displayed only after the primary game outcome is at least partially displayed, the secondary game being different from the primary game, the second display including a space identifier sequentially moving along a plurality of selectable spaces of a trail defined by a gaming board, the space identifier stopping on a selected one of the plurality of selectable spaces to indicate the secondary game outcome of the secondary game; and a programmable controller for operating the first display and the second display, the controller awarding a first award if the primary outcome is a winning outcome, the controller awarding a second award only if the winning outcome is achieved and the secondary outcome has a predetermined game-play association with the winning outcome.

2. The machine of claim 1, wherein the winning outcome is represented by first indicia and wherein the secondary outcome is represented by second indicia, the controller awarding the second award if the second indicia substantially matches the first indicia.

3. The machine of claim 1, wherein the primary outcome is represented by a plurality of symbols and wherein the secondary outcome is represented by an additional symbol.

4. The machine of claim 3, wherein the predetermined association includes a substantial match between the additional symbol and at least one of the plurality of symbols of the winning outcome.

5. The machine of claim 4, wherein the plurality of symbols of the winning outcome substantially match each other.

6. The machine of claim 3, wherein the first display includes a plurality of symbol-bearing slot reels that are rotated and stopped to place the plurality of symbols in visual association with a display area of the first display.

7. The machine of claim 6, wherein the slot reels are simulated in video.

8. The machine of claim 6, wherein the slot reels are physical and driven by one or more motors.

9. The machine of claim 3, wherein the second display includes a game board having a plurality of regions, the regions containing respective second symbols, the second display being operated to randomly select the additional symbol from the second symbols.

10. The machine of claim 1, wherein the primary and secondary outcomes are randomly selected from a plurality of possible outcomes.

11. The machine of claim 1, wherein the first display includes a reel spinning display and wherein the second display includes at least one of a wheel and a game board containing a plurality of selectable visible regions.

12. The gaming machine of claim 1, wherein said secondary award is variable.

13. The gaming machine of claim 1, wherein the gaming board includes an interior display area for displaying an enlarged view of the selected one of the plurality of selectable spaces.

14. A gaming machine for conducting a wagering game, comprising:

a spinning reel display for displaying a plurality of reel symbols representing a primary game outcome of a primary game;

a bonus video display for displaying an additional symbol representing a secondary game outcome of a secondary game, the secondary game being different from the primary game and lacking spinning reels, the bonus video display having a space identifier randomly moving along a plurality of selectable spaces of a gaming board, the space identifier moving before the primary game outcome is displayed in its entirety, the space identifier stopping on a selected one of the plurality of selectable spaces to indicate the secondary game outcome of the secondary game; and a programmable controller for operating the spinning reel display and the bonus display, the controller having a random number generator for determining the primary game outcome and the secondary game outcome, the controller awarding a first award if the primary outcome is a winning outcome, the controller awarding a second award only if the winning outcome is achieved and the secondary outcome has a predetermined game-play association with the winning outcome.

15. The machine of claim 14, wherein the bonus display includes at least one of a wheel and a game board.

16. The machine of claim 14, wherein the primary and secondary outcomes are randomly selected.

17. A method of conducting a wagering game, comprising:

determining a primary game outcome of a primary game and a secondary game outcome of a secondary game using a programmable controller;

in response to the determining step, displaying the primary game outcome on a first display;

displaying the secondary game outcome on a second display, the second display being a video display, the secondary game outcome being displayed only after the primary game outcome is at least partially displayed, the secondary game being different from the primary game;

sequentially moving a space identifier along a plurality of selectable spaces of a trail defined by a gaming board, the gaming board being displayed on the second display, the space identifier moving before the primary game outcome is displayed in its entirety;

stopping the space identifier on a selected one of the plurality of selectable spaces to indicate the secondary game outcome of the secondary game awarding a first award if the primary outcome is a winning outcome; and awarding a second award only if the winning outcome is achieved and the secondary outcome has a predetermined game-play association with the winning outcome.

18. The method of claim 17, wherein the winning outcome is represented by first indicia and wherein the secondary outcome is represented by second indicia, and wherein the step of awarding a second award includes awarding the second award if the second indicia substantially matches the first indicia.

19. The method of claim 17, wherein the primary outcome is represented by a plurality of symbols and wherein the secondary outcome is represented by an additional symbol.

20. The method of claim 19, wherein the predetermined association includes a substantial match between the additional symbol and at least one of the symbols of the winning outcome.

21. The method of claim 20, wherein the plurality of symbols of the winning outcome substantially match each other.

22. The method of claim 19, wherein the first display includes a plurality of symbol-bearing slot reels that are rotated and stopped to place the plurality of symbols in visual association with a display area of the first display.

23. The method of claim 22, wherein the slot reels are simulated in video.

24. The method of claim 22, wherein the slot reels are physical and driven by one or more motors.

25. The method of claim 19, wherein the second display includes a game board having a plurality of regions, the regions containing respective second symbols, and further including randomly selecting the additional symbol from the second symbols.

26. The method of claim 17, further including randomly selecting the primary and secondary outcomes from a plurality of possible outcomes.

27. The method of claim 17, wherein the spinning reel display includes a reel spinning display and wherein the bonus video display includes at least one of a wheel and a game board containing a plurality of selectable visible regions.

28. A method of conducting a wagering game, comprising:

determining a primary game outcome of a primary game and a secondary game outcome of a secondary game using a programmable controller;

in response to the determining step, displaying a plurality of reel symbols representing the primary game outcome on a spinning reel display;

displaying an additional symbol representing the secondary game outcome on a bonus video display, the secondary game being different from the primary game and lacking spinning reels, the bonus video display including at least one of a wheel and a game board defining a trail containing a plurality of selectable visible regions, the trail showing at least one moving element;

awarding a first award if the primary outcome is a winning outcome; and awarding a second award only if the winning outcome is achieved and the secondary outcome has a predetermined game-play association with the winning outcome.

29. The method of claim 28, wherein the primary and secondary outcomes are randomly selected.

* * * * *